United States Patent [19]

Farmer

[11] Patent Number: 4,986,437

[45] Date of Patent: Jan. 22, 1991

[54] SPILL RESISTANT LID

[76] Inventor: Herbert B. Farmer, 1070 Windsor, Salt Lake City, Utah 84105

[21] Appl. No.: 713,417

[22] Filed: Mar. 18, 1985

[51] Int. Cl.[5] ..... A47G 19/22

[52] U.S. Cl. ..... 220/90.2; 220/90.4

[58] Field of Search ..... 220/90.2, 90.4, 90.6

[56] References Cited

U.S. PATENT DOCUMENTS

| | | | |
|---|---|---|---|
| 4,083,467 | 4/1978 | Mullins et al. | 220/90.4 |
| 4,146,157 | 3/1979 | Dixon, Sr. et al. | 220/90.4 X |
| 4,210,256 | 7/1980 | Amberg et al. | 220/90.4 X |
| 4,350,260 | 9/1982 | Prueher | 220/90.4 X |
| 4,441,623 | 4/1984 | Antoniak | 220/90.4 |
| 4,503,992 | 3/1985 | Sitko et al. | 220/90.2 X |

*Primary Examiner*—Steven M. Pollard

[57] ABSTRACT

A spill resistant lid is adapted to be removably and securely attached to an open-topped beverage container. The lid is formed with a generally cylindrical wall and floor which define a closure member over the beverage container when the lid is placed thereon. The floor of the closure member includes a liquid dispensing hole located in or adjacent the cylindrical wall, and a pressure equalization hole diagonally opposite the liquid dispensing hole. In order to aid a user in locating the liquid dispensing hole solely by feel, as in total darkness, the lid includes a generally semi-funnel shaped dispensing spout formed in the generally cylindrical wall in radial alignment with, and adjacent, the liquid dispensing hole. The floor defining the closure member of the lid is inclined downwardly toward the liquid dispensing hole, so that any residual liquid left in the reservoir will gravity drain back into the beverage container. The liquid dispensing spout includes a raised semi circular edge which assists the user in locating the dispensing spout, and therefore the liquid dispensing hole.

6 Claims, 1 Drawing Sheet

SPILL RESISTANT LID

BACKGROUND OF THE INVENTION

1. Field

The invention is in the field of spill resistant lids or caps for beverage cups or glasses.

2. State of the Art

There are various lids or caps currently available to be placed on beverage cups or glasses to help prevent spillage of the beverage contained therein. A common type of lid is a disposable lid made of a thin plastic material which is snapped onto the top of paper or plastic soft drink cups at fast food restaurants. This type of lid has either an X shaped cut or a perforated circular hole in the top through which a straw is inserted. For hot drinks such as coffee served by fast food restaurants or convenience stores, similar lids or caps are provided, but usually must be removed prior to use. With the lids removed, all spill resistance is lost.

There have recently been introduced in the market a number of non-disposable cups or similar containers having removable lids thereon with openings therein so that coffee or other hot beverages can be carried in a spill resistant manner and can be drunk from such containers through the opening in the lid. Some of these containers have drinking openings wherein a closure means is operated by the user's tongue or by the users finger. Other lids merely have small openings therein, some with a lip about the circumference of the lid to provide a reservoir for any liquid that does escape through the hole. With such lids, however, unless one can see the hole in the lid, it is difficult to align the hole with the user's mouth to prevent spillage. The user may attach the lid to the cup or container and position the access hole relative to the container handle so that he always drinks from the general area of the lid access hole. However, for commonly used disposable cups that have no handle, attempting to relocate the lid access hole each time the user takes a drink can be quite annoying, especially when holding the container one-handedly in the dark, as when driving an automotive vehicle at night.

SUMMARY OF THE INVENTION

According to the present invention, a spill resistant lid is adapted to be removably and securely attached to an open-topped drinking container. The lid has a first cylindrical wall formed with an annular ledge to define an annulus for receiving therein the top edge or rim of the container in snap-fitting relation. A second cylindrical wall, generally concentric with the first wall, is formed at the inner edge of the annular ledge, which, in combination with a floor formed with said wall, defines a reservoir for holding liquid when the lid is in position on the container, the floor also forming a cover for the container to prevent spillage of the liquid in the container. The floor has a liquid dispensing hole adjacent its lowermost surface for directing liquid flow from within the container. The second cylindrical wall which forms the reservoir side walls has a spout portion formed therein in radial alignment with the liquid dispensing hole, so that the user can, by feel, locate the spout, and therefore the hole in the lid, in order to drink from the container without spilling the liquid.

THE DRAWINGS

In the accompanying drawings, which illustrate an embodiment of the invention constituting the best mode presently contemplated of carrying out the invention in actual practice:

FIG. 1 is a pictorial view of the spill resistant lid of the present invention, along with a conventional disposable container with which the lid is intended to be used;

FIG. 2, a top plan view of the spill resistant lid of the present invention;

FIG. 3, a side elevation of the spill resistant lid as shown in FIG. 2;

FIG. 4, a vertical section taken along the line 4—4 in FIG. 2, also showing the snap-fit relation between the spill resistant lid and the disposable container which is shown in phantom; and FIG. 5, a vertical section similar to FIG. 4 but showing a slightly different embodiment of the lid.

DETAILED DESCRIPTION

Figure 1:
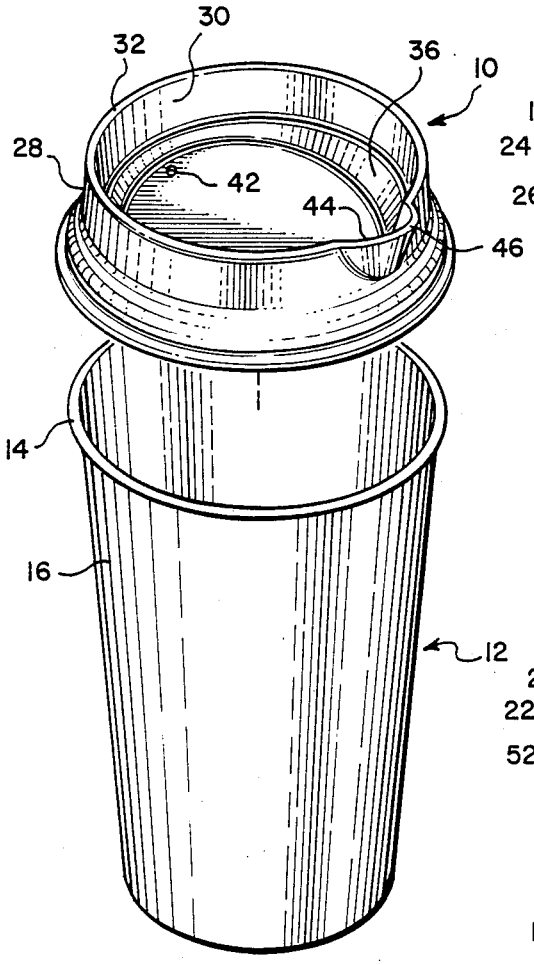

Turning now to the drawings, and initially to FIG. 1, the spill resistant lid of the present invention is shown generally illustrated by the numeral 10. The lid is adapted to be securely, yet removably attached to an open-topped beverage container, such as a cup or glass 12. The lid of the present invention is particularly adapted for use with disposable beverage containers similar to the one illustrated and made of paper, plastic, or a polystyrene foam material. As shown, a conventional disposable beverage container (all such containers being referred to herein as a cup) includes an upper rim defining a lip 14 formed with the side wall 16 for imparting structural integrity to the cup in order to prevent collapse of the cup during normal use.

Figure 4:
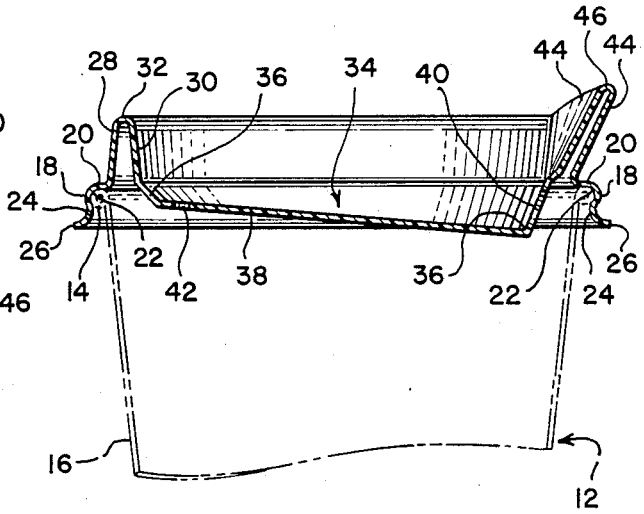

Referring now to FIG. 4, where the spill resistant lid is shown in vertical section, the lid includes a first cylindrical wall 18 which is formed with an annular lid ledge 20. The first wall 18 and annular ledge 20 combine to form an annulus 22 for receiving the cup rim lip 12 in secure, yet removable relationship. The lid first wall 18 may also include an inwardly facing toroidal-like shaped annular ridge 24 which forms an over-center type snap-fit of the cup rim lid 14 into the annulus 22. In this regard, the lower portion of the first wall 18 forming the annular ridge 24 may also include an outwardly flaring lip 26. This lip 26 imparts a structural integrity to the lid first wall 18 and provides additional support for the annular ridge 24. Additionally, the lip 26 serves as an automatic centering device when placing the lid on a cup, and, depending on the type of cup used, causes an outward deflection of ridge 24, an inward deflection of cup rim 14, or both as the cup rim 14 is moved into annulus 22. Also, lip 26 provides an edge surface by which the user may grasp the lid for easy removal from the cup.

A second, generally cylindrical wall 28 is formed with the inside edge of the annular ledge 20, and extends upwardly from the ledge. In the preferred embodiment shown, this second wall 28 is connected at the top to a third generally cylindrical wall 30, the union of these two walls defining a rounded edge 32. The particular embodiment illustrated and described herein may be a disposable type lid, vacuum formed from a thin plastic film. Those skilled in the art should readily appreciate the spill resistant lid of the present invention may also be formed of a heavier plastic, and/or formed with a single solid, thicker wall rather than the illustrated second and third walls 28 and 30.

Returning to FIG. 4, the lower portion of the third cylindrical wall 30 is formed with a floor 34, which in the embodiment shown, comprises an intermediate annular bevelled section 36 which interconnects the third wall 30 with a generally planar section 38. In the embodiment shown, this annular bevelled section 36 is eccentric with the third cylindrical wall 30, in order that the planar section 38 may be inclined slightly relative to the plane of the annular ledge 32 and the cup rim lip 14. The third wall, the intermediate section and the planar section define a reservoir for a liquid within the lid. More importantly, however, the third wall, the intermediate section and the planer section form a closure member for the cup to prevent spillage of the liquid in the cup when the cup is jostled about, as when the user is drinking from the cup while driving an automobile.

Figure 2:
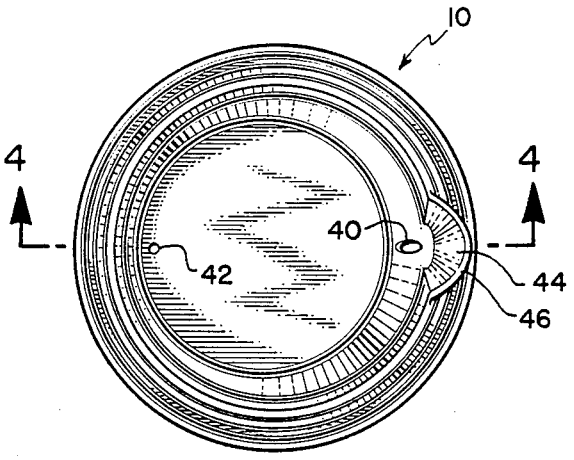

As best shown in FIG. 2, the spill resistant lid of the present invention includes a liquid dispensing hole 40 located in the intermediate annular bevelled section 36 of the lid floor 34. Hole 40 is oval in shape, and is oriented lengthwise along a radius from the geometric center of the lid. The inventor has determined that an oval shaped hole oriented as in the present lid funtions much better than other shapes and orientations in preventing liquid from splashing through the hole when the contents of the cup is jostled about. Placing the hole 40 in the sloped beveled section 36 also tends to lessen splashing of the liquid through the hole. The hole 40 is located adjacent the lowermost portion of the inclined planar section 38 in order to permit liquid collected in the reservoir to return to the cup when the cup is again uprighted.

Because the spill resistant lid of the present invention provides a fluid-tight seal between the annulus 22 and the rim lip 14, a pressure equilization hole 42 is formed in the lid floor 34. In the embodiment illustrated and described, this pressure equilization hole is formed in the floor section 38. It will be appreciated, however, that a pressure equilization hole may be formed in the intermediate bevelled section 36, or in any other convenient place, the only criterian being that the pressure equilization hole be diagonally opposite the liquid dispensing hole in the lid.

Figure 3:
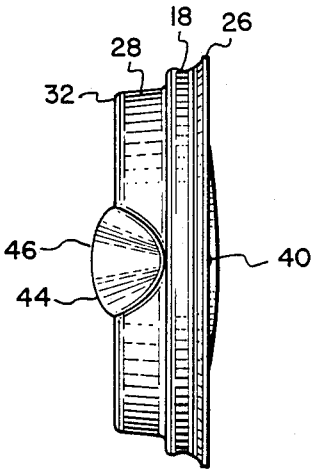

When using a beverage cup having no separate handle, as in the one illustrated at 12, it is frequently difficult for the user to align the liquid dispensing hole 40 with his mouth, especially if the user is sipping from the cup occasionally while he is performing another activity that requires his constant and uninterrupted visual attention, as for example, in driving a motor vehicle. The dispensing of the liquid from hole to mouth is further complicated when the user is driving at night, as for example, when a long-haul truck driver sips coffee as he drives in an effort to maintain his alertness. To aid such a user, the spill resistant lid of the present invention includes a liquid dispensing spout 44 formed with a circumferential edge of the second and third cylindrical walls 28, 30, and positioned in radial alignment with the liquid dispensing hole 40. In the embodiment shown and described herein, the liquid dispensing spout 44 is formed in the shape of a semi-funnel, having a flared, generally semicircular edge 46 at the top which funnels down to, and forms a smooth transision with, the surface of the intermediate bevelled section 36 immediately adjacent the liquid dispensing hole 40. As shown in FIG. 3, the semicircular edge 46 is raised slightly from the plane of the annular edge 32 which forms the juncture of the second and third cylindrical walls 28 and 30. The purposes of this edge 46 being raised are to (1) aid the user in locating the liquid dispensing hole 40 solely by feel, and (2) provide and extend height to the liquid dispensing spout 44 to prevent premature dispensing, i.e. spillage, of liquid from the beverage cup or the reservoir formed in the lid as the user turns the cup up to drink therefrom.

Those skilled in the art will readily appreciate that the overall concept of the spill resistant lid of the present invention as described herein is particularly advantageous in enabling the user to locate the liquid dispensing hole solely by feel in order to align the liquid dispensing hole with his mouth to permit the user to consume a beverage from the cup and eliminate the possibility of spilling the beverage as he drinks from the container. While a specific configuration of dispensing spout has been illustrated and described and such configuration is that presently contemplated as the best mode of carrying out the invention from the standpoint of ease of use and ease of manufacture, it should be realized that various other shapes or configurations of the spout can be used, the important feature being that the spout serves as an indication by feel to the user of the location of the liquid dispensing hole 40. For example, the spout could be somewhat retangular rather than semicircular as shown.

Figure 5:
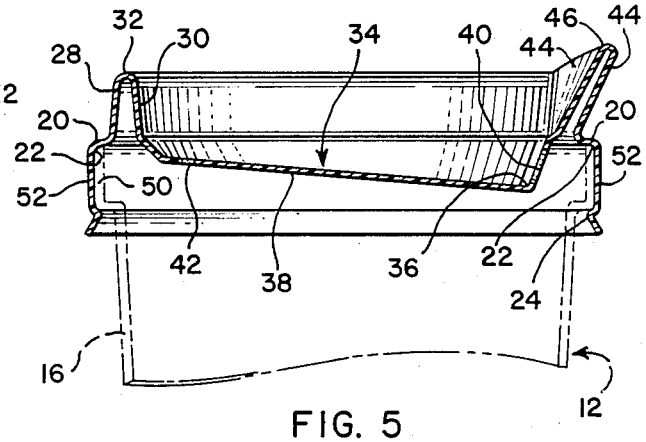

FIG. 5 shows a variation of the lid of the invention adapted specifically for use with foam plastic hot drink cups which have an extended top margin 50 rather than the lip 14. In this instance the first cylindrical wall 52 corresponding to cylindrical wall 18 in the other figures is extended so that ridge 24 fits below margin 50 as shown. The remainder of the lid is the same as previously described.

With the sloped bottom 38 of the lid when used with light weight disposable cups, if the cup is knocked over, the cup will roll so that opening 40 is adjacent the upper side of the overturned cup, with the pressure equalization hole 42 at the lower side. Because the pressure equalization hole 42 is generally much smaller than hole 40 this reduces the spillage of liquid if the cup is knocked over.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A spill resistant lid adapted to be removably and sealably attached to a an open-topped container, said lid comprising;

a first cylindrical wall adapted to receive in close fitting relationship therein the open top of said container;

a second substantially cylindrical wall being of a smaller diameter than, and substantially concentric with, said first cylindrical wall;

an annular edge interconnecting said first and second walls;

a third substantially cylindrical wall concentric with and connected at its upper edge to said second wall;

a substantially planar floor connected to said third wall in a manner to be inclined slightly relative to the plane of said annular ledge;

an intermediate, bevelled section interconnecting said floor and said third wall, said third wall, said intermediate section, and said floor defining a reservoir for holding liquid therein, said intermediate section including an oval discharge hole oriented radially lengthwise therein for the passage of liquid therethrough; and said second and third cylindrical walls defining a spout in radial alignment with said discharge hole in said intermediate section.

2. The lid as set forth in claim 1, wherein said lid includes a second hole positioned generally diagonally opposite said first hole, said second hole for permitting entrance of air to maintain pressure balance within said container.

3. A spill resistant lid adapted to be removably and sealably attached to an open-topped container, comprising;

a first cylindrical wall adapted to receive in close fitting relationship therewith the open top of said container, said cylindrical wall including an inner annular ledge formed therewith to receive thereagainst the top rim of the container;

a second substantially cylindrical wall concentric with said first wall and extending above the plane of the annular ledge;

an eccentric annular inward bevel at the inner bottom of the second wall;

a substantially planar floor connected to the annular bevel so as to be inclined relative to the plane of the annular ledge, said floor, bevel, and second wall defining a reservoir for holding liquid therein;

an oval hole for the discharge of liquid from the container located in the bevel at its widest portion, said hole being oriented radially lengthwise with its inner end beginning substantially at the junction of the bevel and the planar floor so that when the container is in upright position, any liquid in the reservoir will drain through such hole into the container.

4. The lid as set forth in claim 3, wherein a spout is formed in the second wall in alignment with the discharge hole.

5. The lid as set forth in claim 3, further including a second hole in said floor positioned diagonally opposite said oval hole.

6. The lid as set forth in claim 3, wherein said second cylindrical wall is formed of two substantially concentric walls connected at the upper adjacent edges thereof.

* * * * *